US007144478B1

(12) United States Patent
Sekiya

(10) Patent No.: US 7,144,478 B1
(45) **Date of Patent: *Dec. 5, 2006**

(54) POLLUTION CONTROL METHOD FOR CYLINDRICAL DRYER USED IN PAPER MACHINE

(75) Inventor: Kunio Sekiya, Tokyo (JP)

(73) Assignee: Maintech Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/806,020

(22) PCT Filed: Sep. 14, 1999

(86) PCT No.: PCT/JP99/05021

§ 371 (c)(1),
(2), (4) Date: Mar. 23, 2001

(87) PCT Pub. No.: WO00/19011

PCT Pub. Date: Apr. 6, 2000

(30) Foreign Application Priority Data

Sep. 25, 1998 (JP) ..... 10/288934

(51) Int. Cl.
*D21F 1/32* (2006.01)

(52) U.S. Cl. ..... 162/199; 162/198; 162/111; 162/112; 162/202; 162/272; 134/10; 134/32; 134/34; 134/42; 427/194; 427/195

(58) Field of Classification Search ..... 162/199, 162/111, 112, 202; 427/194, 195; 134/10, 134/32, 34, 42
See application file for complete search history.

(56) References Cited

U.S. PATENT DOCUMENTS 3,014,832 A * 12/1961 Donnelly ..... 162/111

FOREIGN PATENT DOCUMENTS

| | | |
|---|---|---|
| JP | 4-130190 | 1/1992 |
| JP | 6-280181 | 4/1994 |
| JP | 7-292382 | 7/1995 |
| JP | 7-292591 | 7/1995 |
| JP | WO 96/38638 | 5/1996 |

OTHER PUBLICATIONS

International Search report for PCT/JP99/05021.

* cited by examiner

*Primary Examiner*—Mark Halpern
(74) *Attorney, Agent, or Firm*—Potter Anderson & Corroon LLP

(57) ABSTRACT

The invention provides a method of preventing contamination of a dryer of a paper machine so that predetermined effects of contamination prevention over the long term can always be ensured while maintaining satisfactory drying efficiency. With the method of preventing contamination of the surface of the drum dryer used in a paper machine, a predetermined amount of a surface treatment agent P is continuously supplied to the surface of the drum dryer C1 in rotation, facing a paper strip W, while the paper strip is being fed by the paper machine in operation.

6 Claims, 7 Drawing Sheets
(2 of 7 Drawing Sheet(s) Filed in Color)

POLLUTION CONTROL METHOD FOR CYLINDRICAL DRYER USED IN PAPER MACHINE

This application is a 371 of PCT/JP99/05021 filed 14 Sep. 1999.

TECHNICAL FIELD

The present invention relates to a method of preventing contamination of a drum dryer used in a paper machine (pollution control method for cylindrical dryer used in paper machine).

BACKGROUND OF TECHNOLOGY

In a paper machine, sheet-shaped wet paper is formed from feed stock, and the wet paper is processed into product paper by removing moisture from the former.

As drying is an essential step for removing moisture, a so-called dry part where a drying process is carried out plays a very important role.

The paper machine is equipped with a plurality of dryers for drying the wet paper, occupying the major part of the paper machine.

The dryers normally have a construction such that the dryers can be heated from inside thereof by introducing heated steam and so forth thereinto.

When moist paper undried as yet is fed to the dry part, the paper is pressed into contact with the surface of the dryers by touch rolls and canvases, and dried.

The surface of the dryers made of metal is generally a rough surface in microscopic terms, and especially since dryers made of casting are in widespread use, it is unavoidable that the surface thereof has such roughness.

Incidentally, paper contains pitch, tar component, and microfibers that are included in pulp feed stock itself, additive chemicals contained in various papers, and other components such as filler. When the paper is pressed against the surface of the dryers, those components described tend to gain adhesiveness due to the effect of heat, and to stick to the surface of the dryers.

For removal of contaminants stuck to the surface of the dryers such as the components described above, there has been normally adopted a method of scraping the contaminants off with a doctor blade, an accessory of the dryers.

However, this causes the surface of the dryers to become rougher due to friction occurring between the doctor blade and the surface of the dryers, the components described above make ingress into recesses in microscopic aspesrities on the rough surface, and stick thereto under the influence of heat and pressure. Then, parts of the surface of the wet paper are transferred to the dryers, and scraped off again with the doctor blade. Thus, there will occur a vicious cycle of the same phenomena being repeated.

As described in the foregoing, since in the case of conventional methods of making paper, the components described above stick to the dryers, and concurrently, the surface structure of paper is stripped off, the method incurs direct or indirect adverse effects caused by the components.

For example, technical problems as described hereinafter will be encountered;

1. Paper powders generated are mixed with products, and especially at the time of printing, transfer of ink to the surface of paper is blocked by the paper powders, causing the phenomenon called "counter" to occur.

2. Causes for unevenness and napping, occurring on the surface of product paper, and degradation in the surface strength of the product paper are created.

3. Thermal conductivity of the surface of the dryers becomes lower, degrading a drying rate of paper.

4. The phenomenon called "picking" whereby the surface of paper is peeled off occurs.

5. There will be an increase in the number of periodical clean-ups required of the dryers.

6. Sticking of paper to the surface of the dryers occurs, resulting in breaks of paper.

Accordingly, attempts have been made to overcome shortcomings as described above as much as possible by applying chromium plating or Teflon coating to the surface of the dryers beforehand, or by applying sufficient oil hardening treatment thereto periodically while the paper machine is out of operation.

However, in the former case, after surface-treated dryers have been in use over time, the treated surface thereof undergoes gradual wear due to friction, resulting in degradation in the effect of contamination prevention.

In the case of degradation in the effect taking place, it is required that the dryers should be replaced with new ones, or the surface thereof is ground, resulting in loss in operation time due to time required for replacement, or extra costs incurred.

Similarly, in the latter case, transfer of oil to paper takes place over time, and as a result, the beneficial effects of oil starts to decline, so that there will be a limitation to the merits of this method.

Thus, the beneficial effects over the long term can not be expected of either of the methods described in the foregoing, and both the methods are therefore not suited for continuous operation on the long term basis.

DISCLOSURE OF THE INVENTION

The invention has been developed in an attempt to solve various problems described in the foregoing.

It is therefore an object of the invention to provide a method of preventing contamination of the dryers of a paper machine so that predetermined effects of contamination prevention over the long term can always be ensured while maintaining satisfactory drying efficiency.

To this end, the inventors have carried out intense studies on the subjects, and discovered as a result that an exfoliative oil film can constantly be maintained on the surface of the dryers by supplying continuously the dryers with oil by a small amount as if oil was kneaded into the dryers. The invention has successfully been developed on the basis of this fact.

That is, the first aspect of the invention provides a method of preventing contamination of the surface of a drum dryer used in a paper machine, whereby a predetermined amount of a surface treatment agent is continuously supplied to the surface of the drum dryer in rotation, facing a paper strip, while the paper strip is being fed by the paper machine in operation.

The second aspect of the invention provides a method of preventing contamination of the surface of a drum dryer, wherein the surface treatment agent in the first aspect of the invention contains oil as the main component thereof.

The third aspect of the invention provides a method of preventing contamination of the surface of a drum dryer, wherein a surface treatment agent prepared by emulsifying oil by the agency of a surfactant is used for the surface treatment agent in the second aspect of the invention.

The fourth aspect of the invention provides a method of preventing contamination of the surface of a drum dryer used in a paper machine, whereby a surface treatment agent is continuously supplied at a spray rate of 0.3 to 500 mg/m$^2$ per min to the surface of the drum dryer in rotation, facing a paper strip, while the paper strip is being fed by the paper machine in operation.

The fifth aspect of the invention provides a method of preventing contamination of the surface of a drum dryer, wherein the drum dryer in any one of the first to fourth aspects of the invention is multiple type drum dryers.

The sixth aspect of the invention provides a method of preventing contamination of the surface of a drum dryer, wherein the drum dryer in any of the first to fourth aspects of the invention is a Yankee drum dryer.

The seventh aspect of the invention provides a method of preventing contamination of the surface of a drum dryer used in a paper machine, said method comprising the following steps 1) to 5):

1) the step of supplying oil to the surface of the drum dryer in rotation, facing a paper strip, while the paper strip is being fed by the paper machine in operation (oil supply step);

2) the step of filing up recesses in microscopic asperities on the surface of the drum dryer with the oil by supplying the oil (fill-up with oil step);

3) the step of forming a thin oil film on the surface of the drum dryer with the recesses in the microscopic asperities thereof already filled up by continuing supply of the oil (oil film forming step);

4) the step of transferring the oil to the paper strip by keeping the drum dryer and the paper strip pressed into contact with each other, depleting the oil film (oil transfer step); and 5) the step of replenishing the drum dryer with the oil continuously supplied upon depletion of the oil film by an amount of the depletion (oil replenishing step).

The method of the invention may comprise a combination of at least two methods, selected from a group of the above-mentioned methods (1) to (7) provided that the method serves the object of the invention.

Operation

By supplying oil continuously by a predetermined amount onto the surface of the drum dryers, recesses in microscopic asperities on the surface thereof are filled up efficiently with oil, smoothing out the surface.

By continuing further supply of oil, an oil film is then formed on the surface of the drum dryers with the recesses in the microscopic asperities, filled up with oil.

The oil film prevents wet paper from sticking to the surface of the drum dryers.

On one hand, oil of the oil film formed on the surface of the drum dryers is transferred to the wet paper, and on the other hand, parts of the surface, where the oil film has been depleted, are replenished with new oil.

BRIEF DESCRIPTION OF DRAWINGS

The patent or application file contains at least one drawing executed in color. Copies of this patent or patent application publication with color drawing(s) will be provided by the Office upon request and payment of the necessary fee.

BEST MODE FOR CARRYING OUT THE INVENTION

Preferred embodiments of the present invention are described hereinafter with reference to the accompanying drawings.

A paper machine is norm ally provided with a dry part, and the dry part comprises heated drum dryers, canvases for pressing wet paper into contact with the drum dryers, canvas rollers for guiding the canvases, and so forth.

A method of preventing contamination according to the invention is applied to the drum dryers assembled to the paper machine.

Contamination of the drum dryers can be prevented by supplying continuously a surface treatment agent by a predetermined amount to the surface of the drum dryers, facing paper.

In carrying out the invention, the surface treatment agent containing oil as the main component is used.

For example, mineral oil, vegetable oil, animal oil, synthetic oil (silicone oil), and so forth are suitable for use as the oil.

Further, since the surface of the drum dryers is heated up to a high temperature (in the range from 50 to 120° C.), oil of a type exfoliative at such a temperature, and not subject to change in property is selected.

It is important to emulsify the oil into water by adding a surfactant thereto, so that spraying can be facilitated as described hereinafter.

A mixing ratio of the surfactant, 5 to 70 wt. % against the oil, is adopted

More specifically, in spraying, use is made of the surface treatment agent prepared by addition of water 3 to 30 times as much as the oil to the oil, as necessary, depending on application conditions such as paper quality, moisture on the surface of the drum dryers, and so forth.

In the case of using wax in the form of solid particles at room temperature for the oil, the wax melts due to the effect of heat of the drum dryers, and is turned to oil in liquid form after sprayed on the surface of the drum dryers.

In supplying the oil onto the surface of the drum dryers, a spray nozzle is used in practice.

As for a supply rate of the oil as the main component of the surface treatment agent, it is required that the oil is sprayed little by little, but in such a way as not to allow depletion of the oil film on the surface of the drum dryers. The supply rate of the oil component to the surface of the drum dryers, coming in contact with a paper strip, is 0.3 to 500 mg/m$^2$ per min, preferably 2 to 200 mg/m$^2$ per min.

If the supply rate is less than 0.3 to 500 mg/m$^2$ per min, recesses in microscopic asperities on the surface of the drum dryers can not be filled up sufficiently, and if the supply rate exceeds 500 mg/m$^2$ per min, dripping of the surface treatment agent containing the oil occurs, causing oil stains on paper to emerge, and resulting in contamination of peripheral equipment.

Now, a series of steps for supplying the surface treatment agent containing the oil onto the surface of the drum dryers, facing paper, are described hereinafter.

Figure 7:
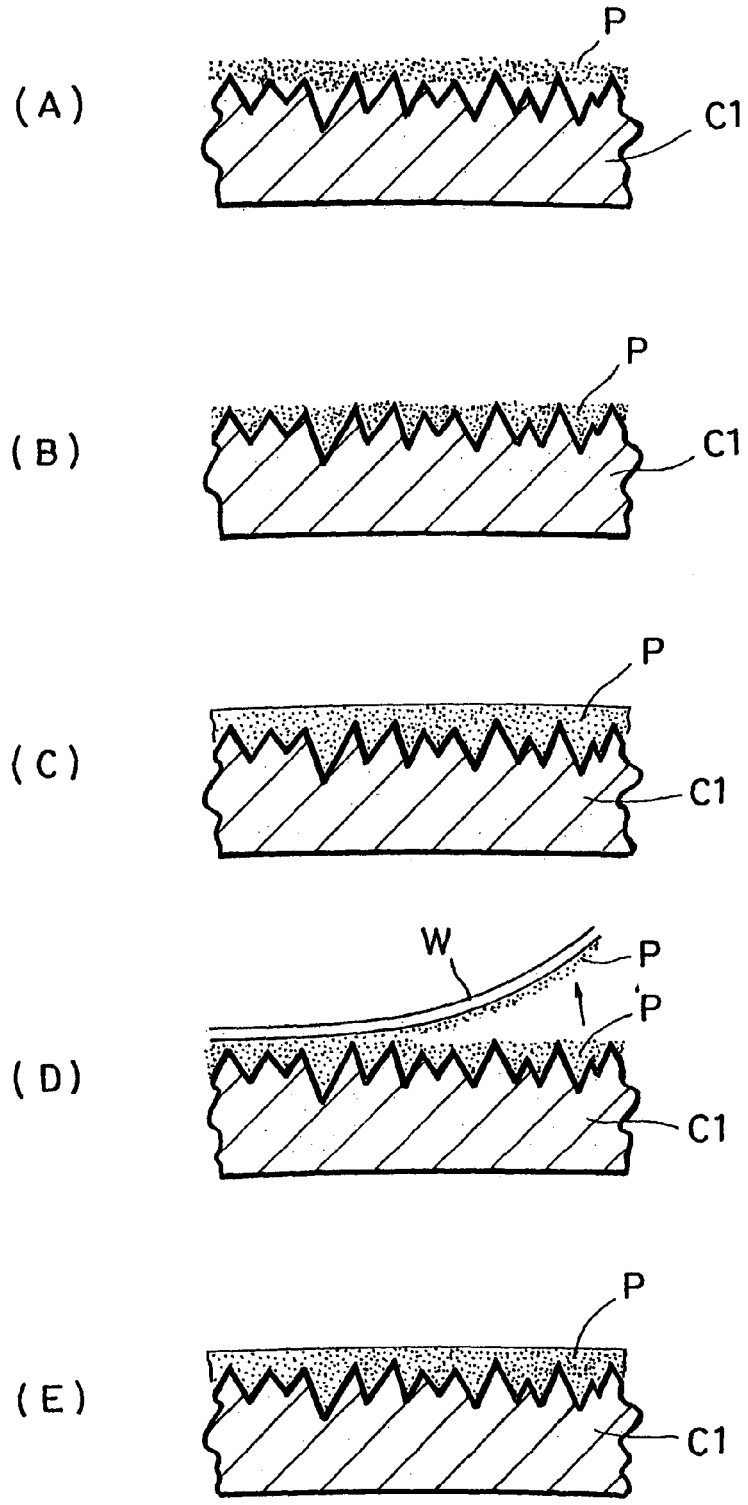
FIG. 7 is a schematic illustration showing a process of treating the surface of the drum dryers.

FIG. 7 is a schematic illustration showing how the surface of each of the drum dryers is treated.

1) Oil Supply Step

When a drum dryer C1 is supplied with the surface treatment agent containing oil P, the canvas is caused to act so as to press a paper strip into contact with the drum dryer, and the oil P supplied onto the drum dryer is adhered to the surface of the drum dryer (A).

2) Fill-up with Oil Step

The oil P adhered to the surface of the drum dryer through continuous supply of the oil proceeds to fill up the recesses in the microscopic asperities (rough surface) of the drum dryer (B).

In this case, viscosity of the oil P becomes lower due to the effect of heat of the drum dryer, allowing the oil P to make ingress into the recesses in the microscopic asperities on the surface of the drum dryer with ease.

3) Oil Film Forming Step

As the oil P is still being supplied to the surface of the drum dryer, already smoothed out by the oil P fling up the recesses in the microscopic asperities thereof, a thin oil film (on the order of several microns in thickness) is formed on the surface of the drum dryer C1 due to the effect of heat and pressure (C).

4) Oil Transfer Step

Meanwhile, as the thin oil film formed on the surface of the drum dryer C1 is kept pressed in contact with the paper strip being fed, the oil P proceeds to be transferred little by little constantly to the paper strip (transfer phenomenon) (D).

As a result, the thin oil film formed on and adhered to the surface of the drum dryer C1 undergoes gradual depletion.

5) Oil Replenishing Step

Since supply of the oil P onto the drum dryer still continues, the drum dryer is immediately replenished with the oil P by an amount of reduction due to the depletion described (E).

Reduction in the oil P, and replenishment thereof are indistinguishable from each other, and occur concurrently in conjunction with each other.

As described above, by supplying the oil continuously to new portions of the surface of the drum dryers in rotation during operation of the paper machine, the steps 1) to 3) described above are carried out.

Then, by further continuing supply of the oil, the steps 4) and 5) described above are carried out.

Thus, by going through each of five steps consisting of the oil supply step, the fill-up with oil step, the oil film forming step, the oil transfer step, and the oil replenishing step, the surface of the drum dryers is maintained in a condition such that a predetermined oil film is constantly formed, enabling the paper machine to maintain continuous operation satisfactorily.

With the method according to the invention, there will be no decline in the effect of contamination prevention following operation of the paper machine over time, unlike the case of a conventional method using drum dryers with any contamination prevention treatment applied to the surface thereof beforehand.

As the oil film has the function of filling up sufficiently the recesses in the microscopic asperities of the drum dryers, the mold-release characteristic of the drum dryers will be improved.

Incidentally, the surface of the drum dryers with the oil film described above formed thereon presents a mirror-like appearance.

Now, as an amount of the oil sprayed is important in carrying out the invention, results of spray tests conducted are shown hereinafter.

Embodiment 1

With a multiple drum-dryer type paper machine (manufactured by K. K. kobayashi Seisakusho) shown in FIG. 1, test operation was carried out for a month, whereby a surface treatment agent was continuously sprayed onto the surface of the dryers through a nozzle of a spray apparatus, and thereafter, the condition of the surface of the dryers at that point in time was observed.

Also, the quality of paper (corrugating medium material) produced during the test was inspected.

(Surface Treatment Agent Used)

A surface treatment agent used in the test was an emulsified aqueous solution prepared by diluting a mixture composed of silicone oil, alcohol, and a surfactant mixed at wt. ratio of 10:8:2 with an equivalent amount of water (specific gravity at about 1.0 g/cc).

(Spray Amount)

7 cc/min

In this case, the size of an area on the surface of the dryers with which a paper strip is pressed into contact was 25 m$^2$ and a supply rate of silicone oil for an unit area per min was:

7 cc/min×1.0 g/ccΠ2×[10/(10+8+2)]Π25 m$^{2=0.07}$ g/m$^2$ per min=70 mg/m$^2$ per min.

(Results)

Figure 8:
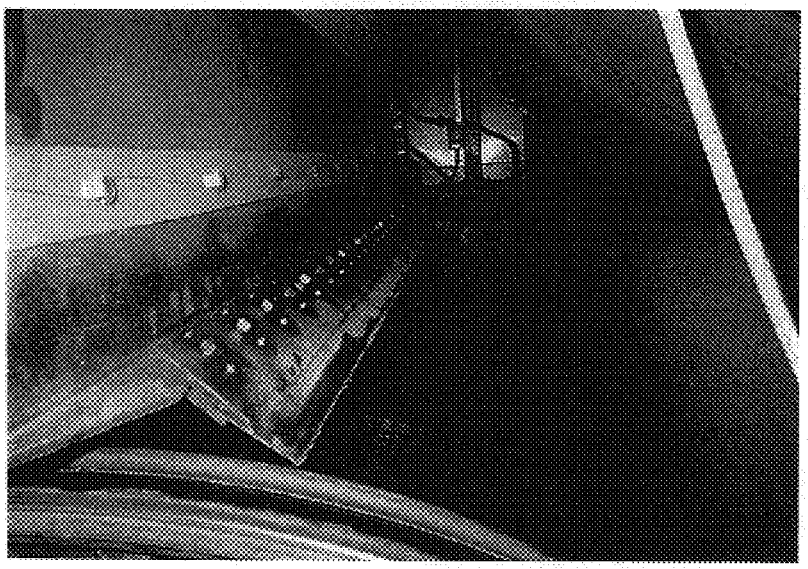
FIG. 8 is a photograph showing the results of an embodiment 1.

The results showed that the surface of the dryers had no adhesive material, and presented a mirror-like appearance (refer to FIG. 8).

Further, an amount of paper powders generated was reduced to less than one tenth of that before application of the technology of the invention.

Embodiment 2

With a multiple drum-dryer type paper machine (manufactured by Mitsubishi Heavy Industries Co., Ltd.), test operation was carried out for a month, whereby a surface treatment agent was continuously sprayed onto the surface of the dryers through a nozzle of a spray apparatus, and thereafter, the condition of the surface of the dryers at that point in time was observed.

Also, the quality of paper (one-side glazed paper) produced during the test was inspected.

(Surface Treatment Agent Used)

A surface treatment agent used in the test was an emulsified aqueous solution prepared by diluting a mixture composed of wax and a surfactant mixed at wt. ratio of 10:1 with water 20 times as much as the wax (specific gravity at about 1.0 g/cc).

(Spray Amount)

2 cc/min

In this case, the size of an area of the surface of the dryers with which a paper strip is pressed into contact was 25 $m^2$ and a supply rate of wax for an unit area per min was:

2 cc/min×1.0 g/ccΠ20 Π25 $m^{2=4\times10-3}$ g/$m^2$ per min=4 mg/$m^2$ per min.

(Results)

The results showed that the surface of the dryers had no adhesive material, and presented a mirror-like appearance.

Further, an amount of paper powders generated was reduced to less than one twentieth of that before application of the technology of the invention, and luster on the surface of the paper was enhanced by 50%.

Embodiment 3

With a multiple drum-dryer type paper machine (manufactured by K. K. Hasegawa Tekkosho) shown in FIG. 1, test operation was carried out for a month, whereby a surface treatment agent was continuously sprayed onto the surface of the dryers through a nozzle of a spray apparatus, and thereafter, the condition of the surface of the dryers at that point in time was observed.

Data were obtained on the quality of paper (low grade printing paper) produced during the test, and an mount of paper powders generated from the dryers.

(Surface Treatment Agent Used)

A surface treatment agent used in the tests was an emulsified aqueous solution prepared by diluting a mixture composed of vegetable oil, wax, and a surfactant mixed at wt. ratio of 10:1:4 with water seven times as much as the mixture (specific gravity at about 1.0 μcc).

(Spray Amount)

4 cc/min

In this case, the size of an area on the surface of the dryers with which a paper strip is pressed into contact was 20 $m^2$ and a supply rate of the vegetable oil and the wax for an unit area per min was:

4 cc/min×1.0 g/ccΠ7×[(10+1)/(10+1+4)]Π20 $m^{2=0.021}$ g/$m^2$ per min=21 mg/$m^2$ per min.

(Results)

Figure 9:
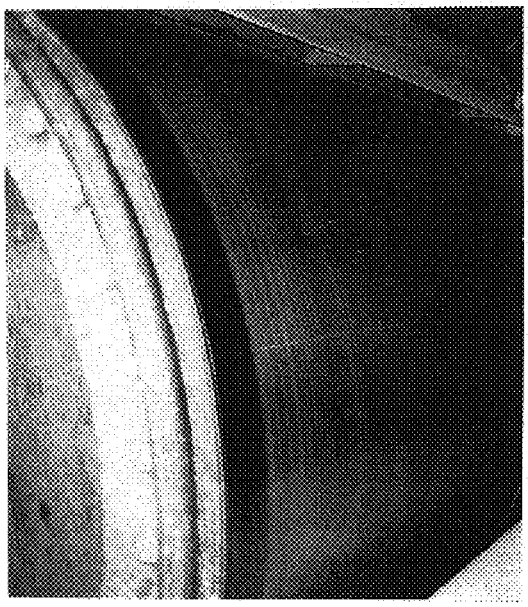
FIG. 9 is a photograph showing the results of an embodiment 3.

The results showed that the surface of the dryers had no adhesive material, and presented a mirror-like appearance (refer to FIG. 9).

Further, an amount of paper powders generated was reduced to less than one tenth of that before application of the technology of the invention, and an amount of steam required for the dryers could also be reduced by 2%.

With the embodiments described in the foregoing, there were two cases where the surface treatment agent was sprayed through the nozzle, and in one case, the surface treatment agent was heated up to 60 to 80° C. Cimmediately before sprayed while in the other case, the surface treatment agent remained at room temperature (on the order of 23° C.).

Test results showed that in the case of spraying at room temperature, the nozzle was clogged up frequently (once a week or every other week) while in the case of heating up the surface treatment agent, no clogging of the nozzle occurred, enabling efficient spraying to be carried out.

COMPARATIVE EXAMPLE 1

Figure 1:
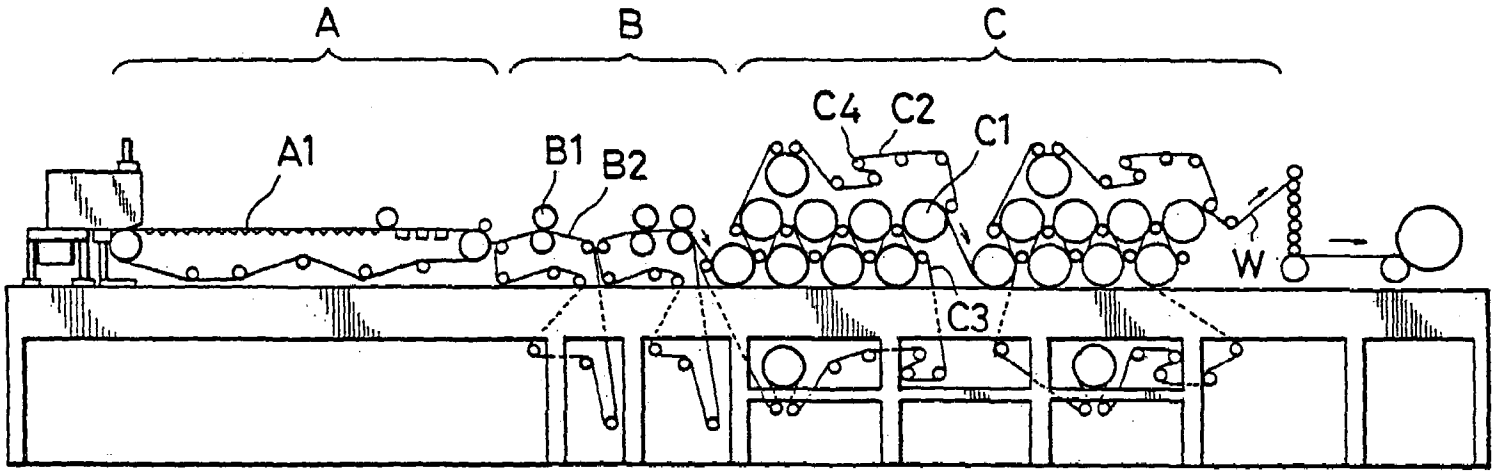
FIG. 1 is a schematic illustration showing a paper machine in whole, provided with multiple drum-dryers.

With a multiple drum-dryer type paper machine shown in FIG. 1, test operation was carried out for a month, using drum dryers with antifouling treatment applied thereto by use of a repellent (Teflon), and thereafter, the condition of the surface of the dryers as well as the surface condition of paper (high and medium grade paper), at that point in time, were observed.

(Results)

Figure 10:
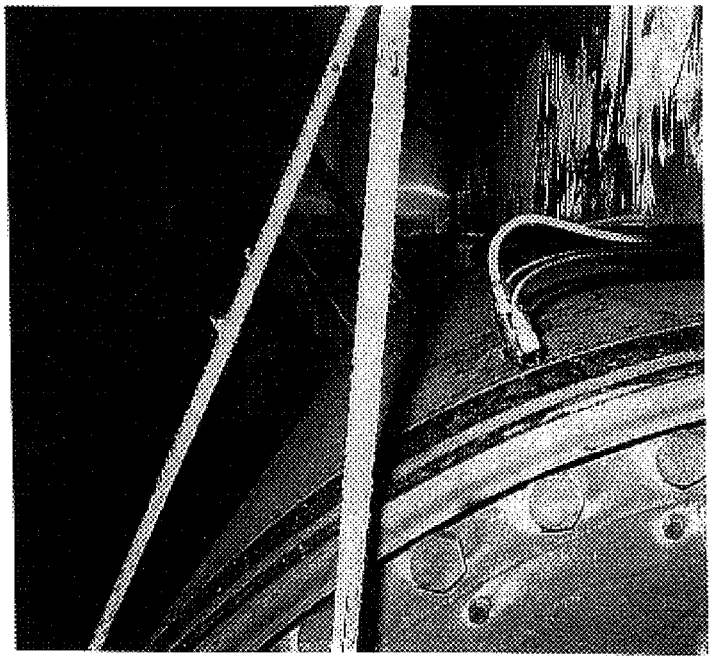
FIG. 10 is a photograph showing the results of a comparative example 1.

The results showed that Teflon on the surface of the dryers underwent wear and tear to a fair degree, and paper powders, pitch, and so forth were found adhered thereto (refer to FIG. 10).

During the test operation, a number of defects caused by paper powders, pitch, and so forth came out on the surface of the paper as well.

COMPARATIVE EXAMPLE 2

After test operation was carried out under the same conditions as for the embodiment 1 for a month, the condition of the surface of the dryers as well as the surface condition of paper (corrugating medium material), at that point in time, were observed (observation 1).

Operation was then resumed in a condition that spraying of the surface treatment agent was suspended, and the surface condition of the dryers five hours later was observed (observation 2).

(Results)

The results showed that upon the observation 1, the surface of the dryers had no adhesive material, and presented a mirror-like appearance, but upon the observation 2, oil on the surface of the dryers was substantially depleted, and paper powders, pitch, and so forth were found adhered to the surface of the dryers with much paper powders accumulating on the doctor.

COMPARATIVE EXAMPLE 3

After test operation was carried out under the same conditions as for the embodiment 1 (the supply rate of silicone oil at 70 mg/$m^2$ per min) for a month, the condition of the surface of the dryers at that point in time was observed (observation 1).

By keeping to increase the spray amount of the surface treatment agent 3-fold, 5-fold, 7-fold, and 9-fold, respectively, every five hours, the surface condition of the dryers was observed, and the quality of a paper strip (liner) produced during tests was also inspected (observation 2).

(Spray Amount)

21, 35, 49, and 63 cc per min, respectively (Oil Supply Rate)

210, 350, 490, and 630 mg/m per min, respectively (Results)

The results showed that upon observation 2 when the spray amount was increased to 21 cc per min (the oil supply rate at 210 mg/$m^2$ per min), a trace of contaminant found adhered to the surface of the dryers upon observation 1 was found substantially disappeared.

When the spray amount was further increased, no change resulted in the surface condition of the dryers, however, it was found that at the spray amount of 63 cc per min (at the oil supply rate of 630 mg/m2 per min), dripping from the dryers of the surface treatment agent in excessive supply occurred, causing the periphery of the dryers to become slippery with the oil.

Also, at this point in time, oil stains appeared on the paper strip.

COMPARATIVE EXAMPLE 4

After test operation was carried out under the same conditions as for the embodiment 2 for a month, the condition of the surface of the dryers at that point in time was observed (observation 1).

By decreasing a supply rate of wax (oil) contained in the surface treatment agent by one tenth, one quarter, one eighth, one twentieth, and one fortieth, respectively, every five hours, while keeping a spray amount of the surface treatment agent at a constant level, the surface condition of the dryers was observed, and the quality of a paper strip (one-side glazed paper) produced during the test was also inspected (observation 2).

(Spray Amount)

constant at 2 cc/min

[Supply Rate of Wax (Oil)]

2, 1, 0.5, 0.2, and 0.1 mg/m per min, respectively (Results)

The results showed that in comparison with the surface condition of the dryers upon observation 1, gradual adhesion of contaminants to the surface of the dryers occurred upon observation 2 when the supply rate declined to 1 $mg/m^2$ per min, however, before the supply rate comes down to 0.5 $mg/m^2$ per min, there was observed no adverse effect on the paper strip.

When the supply rate comes down as low as 0.2 $mg/m^2$ per min, the surface of the dryers became clouded up due to contamination, generating paper powders. When the supply rate comes down to 0.1 $mg/m^2$ per min or less, there was observed a sudden increase in an amount of contaminants adhered to the surface of the dryers, generating massive paper powders while degrading luster on the paper strip, so that contamination of the dryers came to present itself as the drawbacks of this method.

Now, for the sake of guidance, a method of spraying the oil, used in carrying out the embodiments and comparative examples, described in the foregoing, is explained hereinafter.

First, FIG. 1 shows a paper machine provided with multiple drum-dryers, comprising broadly a wire part A, a press part B, and a dry part C.

Operation of the paper machine is briefly described as follows.

In the wire part A, feed stock (pulp and so forth) is fed from a flow spreader head box onto a Fourdrinier wire table A1 evenly so as to be formed into a sheet-like shape.

A paper strip W formed in a sheet-like shape will have the moisture thereof reduced to the order of 80% while passing through the Fourdrinier wire table A1, and be transferred then to the press part B.

In the press part, the paper strip W is squeezed from the upper side as well as the underside by a pressure roller B1, an endless belt B2, and so forth.

The paper strip W will have the moisture thereof reduced to the order of 50% while passing through the press part B, and thereafter, be transferred to the dry part (drying part) C.

In the dry part C, the greater part of humidity contained in the paper strip is given off, and the moisture of the paper strip W is reduced to the order of 10%.

More specifically, the dry part C is provided with heated dryers C1, canvases C2, C3 for pressing the paper strip against the dryers, canvas rollers C4, and so forth for guiding the canvases, so as to cause the paper strip W to give off the moisture thereof by the effect of heat.

Figure 2:
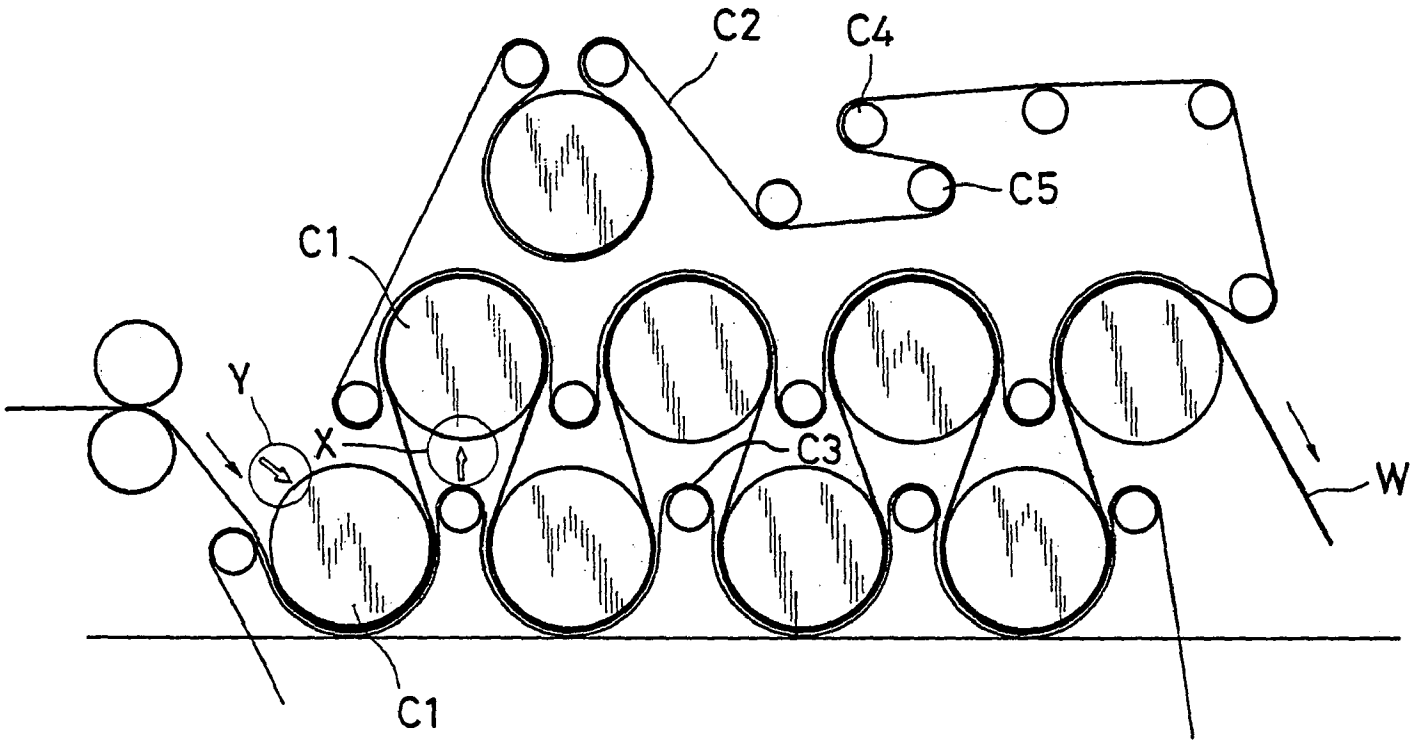
FIG. 2 is an enlarged view of one of dry parts of the paper machine, provided with the multiple drum-dryers.

The paper machine shown in FIG. 1 comprises two dry parts, and FIG. 2 is an enlarged view of one of the dry parts.

The dry part C has a construction such that the canvases C2, C3, disposed on the upper side and the lower side, respectively, are caused to run by a plurality of canvas rolls along paths in a given closed loop, respectively, so as to be pressed into contact with a plurality of the dryers.

The drum dryers C1 in use are of a multiple type, and a plurality thereof are juxtaposed on the upper level as well as the lower level, respectively.

The canvases C2, and C3 act to press the paper strip into contact with the respective dryers, and run between the respective canvas rolls C4, and so forth, in sequence.

In the dry part C described above of the paper machine, the paper strip W (in fact, wet paper) is fed thereto, and transferred along a given path, being held in contact with both the canvases and the dryers.

Drying of the paper strip gradually proceeds as it is pressed into contact with both the canvases and the dryers at the upper level, and the lower level, respectively.

The object of the invention is attained by spraying the surface treatment agent to the surface of the dryers C1, facing the paper strip, in the dry part described in the foregoing (refer to the sites denoted by X and Y, respectively, in FIG. 2).

Figure 3:
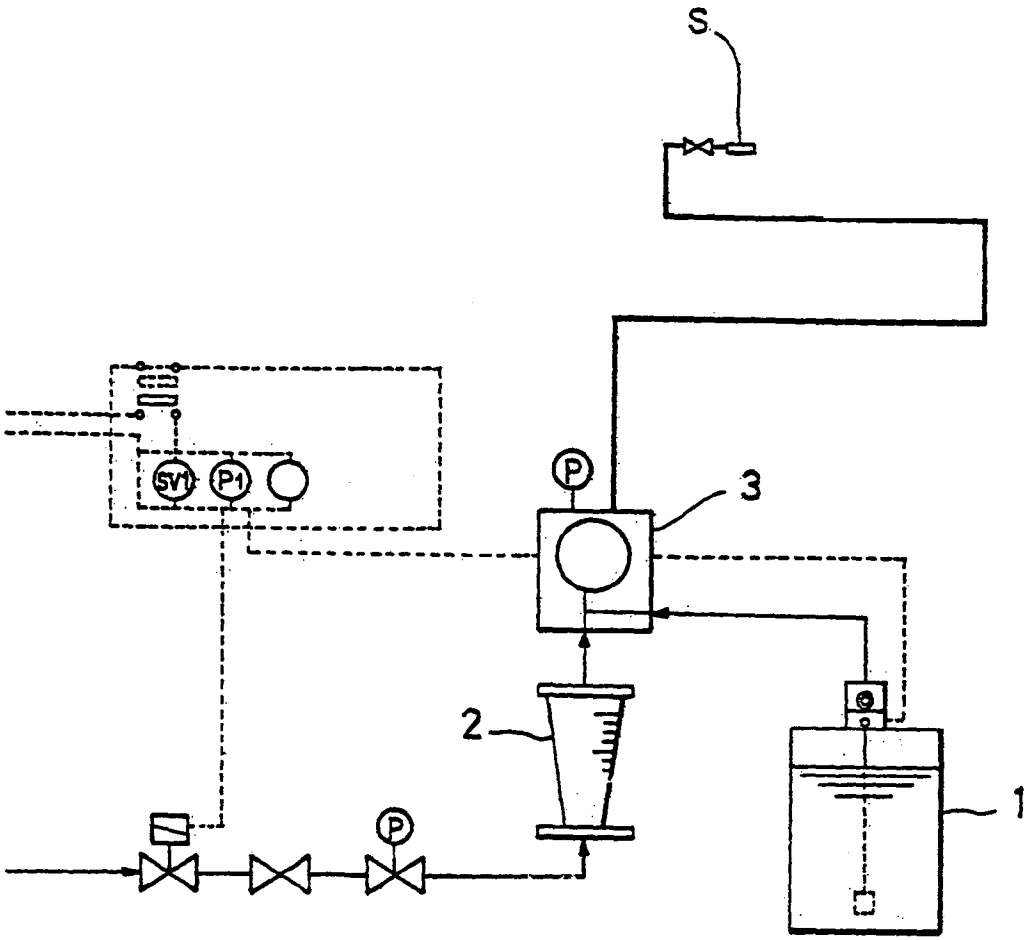
FIG. 3 is a schematic illustration showing a chemical spray unit used for spraying a surface treatment agent.

FIG. 3 shows a chemical spray unit used for spraying chemical, that is, the surface treatment agent.

With the chemical spray unit, the surface treatment agent delivered from a chemical tank 1 is sprayed to the surface of the dryers through a spray nozzle S.

Water may be taken in via a flow meter 2 as necessary, and mixed with the surface treatment agent through a mixer 3 so that water can be sprayed simultaneously through the spray nozzle S.

A method of spraying onto the dryers may be selected in various ways by changing the spray nozzle.

Figure 4:
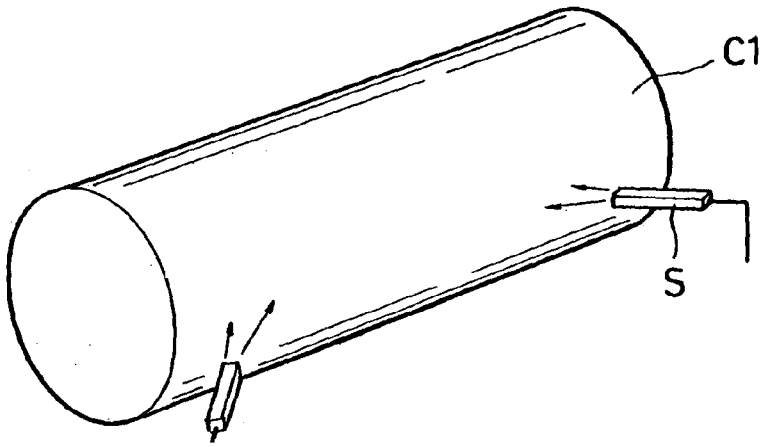
FIG. 4 is a view showing a state of spraying the surface treatment agent through fixed type spray nozzles of the chemical spray unit.
Figure 5:
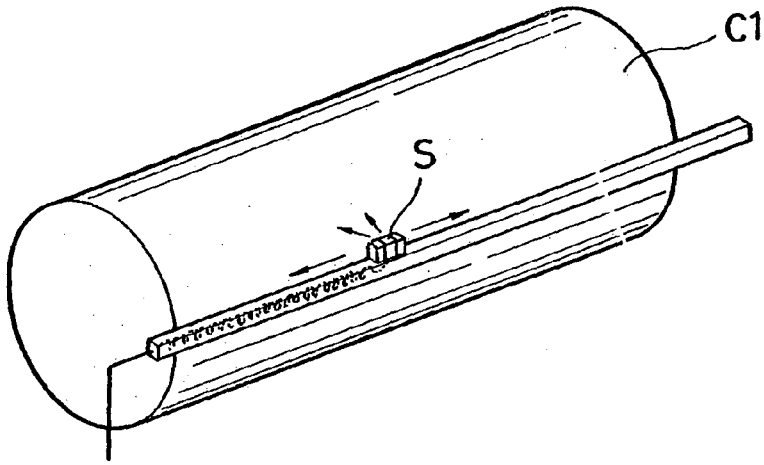
FIG. 5 is a view showing a state of spraying the surface treatment agent through a movable type spray nozzle.
Figure 6:
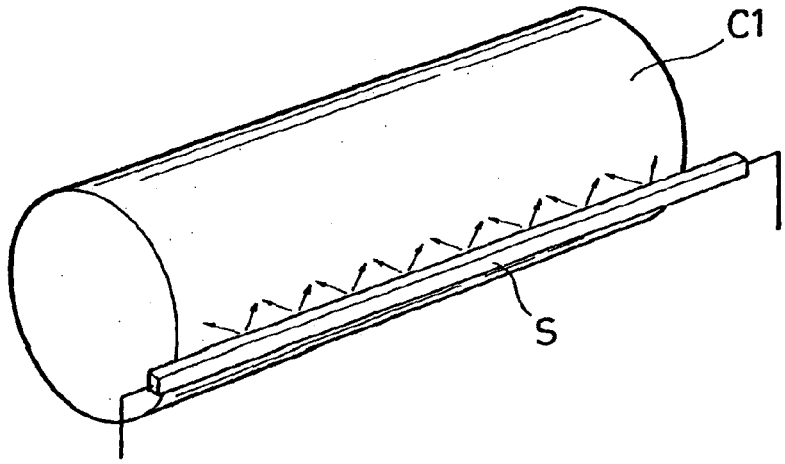
FIG. 6 is a view showing a state of spraying the surface treatment agent through spray nozzles disposed lengthwise.

FIGS. 4 to 6 are schematic illustrations showing various states in which the surface treatment agent is sprayed.

FIG. 4 is a view showing a spraying state wherein the surface treatment agent is sprayed onto the surface of a dryer through fixed type spray nozzles of the chemical spray unit, FIG. 5 a view showing a spraying state wherein the surface treatment agent is sprayed onto the surface of a dryer through a movable spray nozzle, and FIG. 6 a view showing a spraying state wherein the surface treatment agent is sprayed onto the surface of a dryer through spray nozzles disposed lengthwise.

While the preferred embodiments of the invention have been described in the foregoing, it is to be understood that the scope of the invention is not limited thereto, and various other modifications may be made without departing from the spirit or scope of the invention.

For example, in the embodiments described hereinbefore, the method according to the invention is applied to the multiple type drum dryers, however, the scope of the invention is not limited thereto, and it goes without saying that the invention can be adapted to a Yankee dryer.

INDUSTRIAL APPLICABILITY

Although the invention is a technology applied to a drum dryer used in a paper machine, it can be utilized in the entire technical field for manufacturing paper which is expected to have the same effect as the invention.

The invention claimed is:

1. A method for preventing contamination of a surface of a drum dryer used in a paper machine comprising the step of continuously supplying a surface treatment agent from a spray nozzle at a spray rate of 0.3 to 500 mg/m$^2$ per min directly to the surface of the drum dryer in rotation, facing a paper strip, while the paper strip is fed by the paper machine, wherein the surface treatment agent is prepared by emulsifying oil by the agency of a surfactant, and wherein the paper strip is not stained by the surface treatment agent containing oil.

2. A method of preventing contamination of the surface of a drum dryer according to claim 1, wherein the drum dryer is multiple type drum dryers.

3. A method of preventing contamination of the surface of a drum dryer according to claim 1, wherein the drum dryer is a Yankee drum dryer.

4. A method for preventing contamination of the surface of a drum dryer as in claim 1, wherein the surface treatment agent is prepared by adding an amount of water to the oil, wherein the amount of water is 3 to 30 times as much as the oil.

5. A method for preventing contamination of the surface of a drum dryer as in claim 1, wherein a mixing ratio of the surfactant ranges from 5 to 70 wt % against the oil.

6. A method of preventing contamination of a surface of a drum dryer used in a paper machine, said method comprising the following steps 1) to 5):

(1) supplying oil from a spray nozzle at a spray rate of 0.3 to 500 mg/m$^2$ per min, directly to the surface of the drum dryer in rotation, facing a paper strip, while the paper strip is fed by the paper machine;

(2) filling up recesses in microscopic asperities on the surface of the drum dryer with the continuing supply of an oil;

(3) forming a thin oil film on the surface of the drum dryer with the recesses of the microscopic asperities thereof already filled up by the continuing supply of the oil;

(4) transferring the oil to the paper strip by keeping the drum dryer and the paper strip pressed into contact with each other, depleting the oil film, wherein the paper strip is not stained by the oil; and (5) replenishing the drum dryer with the oil continuously supplied upon depletion of the oil film by an amount of depletion.

* * * * *